United States Patent [19]

Chang et al.

[11] Patent Number: 4,631,041

[45] Date of Patent: Dec. 23, 1986

[54] MINIATURE FLYWHEEL CAR FOR SIDE-WHEELIE STUNTS

[75] Inventors: Richard Chang, Rolling Hills Estates; Walter Nakano, Manhatten Beach, both of Calif.

[73] Assignee: Mattel, Inc., Hawthorne, Calif.

[21] Appl. No.: 823,169

[22] Filed: Jan. 27, 1986

[51] Int. Cl.[4] ..... A63H 1/00

[52] U.S. Cl. ..... 446/233; 446/462

[58] Field of Search ..... 446/462, 457, 464, 458, 446/463, 465, 437, 233

[56] References Cited

U.S. PATENT DOCUMENTS

| | | | |
|---|---|---|---|
| Re. 30,299 | 6/1980 | Greenwood | 446/233 |
| 1,538,205 | 5/1925 | Munday | 446/457 |
| 2,560,739 | 7/1951 | Perez . | |
| 2,677,216 | 5/1954 | Hein | 446/462 |
| 2,873,553 | 2/1959 | Ullman | 446/462 |
| 3,698,129 | 10/1972 | Lemelson . | |
| 3,772,824 | 11/1973 | Terzian et al. . | |
| 3,812,933 | 5/1974 | Darda | 185/37 |
| 3,955,429 | 5/1976 | Holden | 74/64 |
| 4,193,223 | 3/1980 | D'Andrade et al. . | |
| 4,241,534 | 12/1980 | Larsson et al. | 446/464 |
| 4,400,908 | 8/1983 | Nomura | 446/462 |
| 4,443,967 | 4/1984 | Jones et al. | 446/462 |
| 4,485,586 | 12/1984 | Halford et al. | 446/448 |
| 4,536,168 | 8/1985 | Stephens | 446/444 |
| 4,556,396 | 12/1985 | Kennedy et al. | 446/462 X |
| 4,565,539 | 1/1986 | Cook | 446/462 |

FOREIGN PATENT DOCUMENTS

| | | | |
|---|---|---|---|
| 1499838 | 2/1978 | United Kingdom | 446/462 |
| 1537342 | 12/1978 | United Kingdom | 446/462 |

*Primary Examiner*—Mickey Yu

*Attorney, Agent, or Firm*—Ronald M. Goldman; Melvin A. Klein; Daniel F. Sullivan

[57] ABSTRACT

A miniature toy car for performing side-wheelie stunts. The toy car has a horizontally mounted flywheel with a vertical spin axis disposed near the bottom of the car. The center of gravity of the flywheel lies substantially in a horizontal plane passing through the rear axle of the car. The inertial motor uses a bevel pinion gear which is attached to the rear axle and engages a change gear. The change gear, in turn, engages a pinion gear attached to the flywheel. The orientation of the flywheel toward the bottom of the car helps to balance the car when it is performing side-wheelie stunts so that the spin axis of the flywheel approaches a horizontal position during such stunts. The sides of the wheels are made of a low friction material which allows the wheels to slide along a supporting surface and make directional changes during side-wheelie stunts as a restoring torque from the inertial motor keeps the car in a balanced position.

3 Claims, 6 Drawing Figures

MINIATURE FLYWHEEL CAR FOR SIDE-WHEELIE STUNTS

BACKGROUND OF THE INVENTION

The present invention relates generally to inertially powered miniature toy vehicles and, more particularly, to an inertially powered miniature toy car utilizing a horizontally disposed flywheel and tires with sides made out of a low friction material to allow the car to perform side-wheelie stunts.

Numerous miniature toy vehicles have used a flywheel for the purpose of inertially powering the vehicles. For example, such vehicles are disclosed in U.S Pat. No. 4,536,168 issued to Stephens on Aug. 20, 1985; U.S. Pat. No. 4,485,586 issued to Halford et al on Dec. 4, 1984; U.S. Pat. No. 4,443,967 issued to Jones et al on Apr. 24, 1984; U.S. Pat. No. 4,400,908 issued to Nomura on Aug. 30, 1983; U.S. Pat. No. 4,193,223 issued to D'Andrade et al on Mar. 18, 1980; U.S. Pat. No. 3,955,429 issued to Holden on May 11, 1976; and U.S. Pat. No. 2,677,216 issued to Hein on May 4, 1954. In addition, U.S. Pat. No. 3,698,129 issued to Lemelson on Oct. 17, 1972 and U.S. Pat. No. 2,873,553 issued to Ullman on Feb. 17, 1958 discribe the use of horizontally disposed flywheels in the driving motors of toy cars. However, the flywheels used for these cars do not facilitate using the cars for side-wheelie stunts. Finally, U.S. Pat. No. 3,812,933 issued to Darda on May 28, 1974; U.S. Pat. No. 3,772,824 issued to Terzian et al on Nov. 20, 1973; and U.S. Pat. No. 2,560,739 issued to Perez on July 17, 1951 disclose spring driven motors used for toy cars.

None of the above patents discloses a miniature toy car which can be used to perform a "true side-wheelie" stunt. During such a stunt, both wheels on one side of a toy car remain in contact with a supporting surface while the axles of the car approach a vertical position. The car remains in this position without additional physical supports as it moves along its intended path.

A horizontally mounted flywheel with a vertical spin axis disposed near the bottom of a toy car would assist in balancing the car during side-wheelie stunts. In addition, the use of low friction material such as plastic at the sides of the wheels would faciliate side-wheelie stunts since such material would allow the wheels to slide over a supporting surface as the car proceeds along its intended route.

SUMMARY OF THE INVENTION

It is an object of this invention to provide a miniature toy car which can be used for side-wheelie stunts.

It is another object of this invention to provide a miniature toy car which utilizes a horizontally mounted flywheel with a vertical spin axis disposed near the bottom of the car to assist in balancing the car during side-wheelie stunts.

It is still another object of this invention to provide a miniature toy car which utilizes a low friction material at the sides of the wheels to allow the wheels to slide over a supporting surface during side-wheelie stunts.

These and other objects and advantages are attained by a toy car capable of performing side-wheelie stunts having a horizontal flywheel with a vertical spin axis disposed near the bottom of the car. The center of gravity of the flywheel lies substantially in a horizontal plane passing through the rear axle of the car. The inertial motor uses a bevel pinion gear attached to the rear axle which engages a change gear. The change gear, in turn, engages a pinion gear attached to the flywheel. The orientation of the flywheel toward the bottom of the car helps to balance the car when it is performing side-wheelie stunts so that the spin axis of the flywheel approaches a horizontal position during such stunts. The sides of the wheels are made of a low friction material which allows the wheels to slide along a supporting surface and make directional changes during side-wheelie stunts as a restoring torque from the inertial motor keeps the car in a balanced position The various features of the present invention will be best understood, together with futher objects and advantages by reference to the following description of the preferred embodiment, taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commerical environment, although it should be understood that various modifications can be accomplished within the parameters of the present invention.

Figure 1:
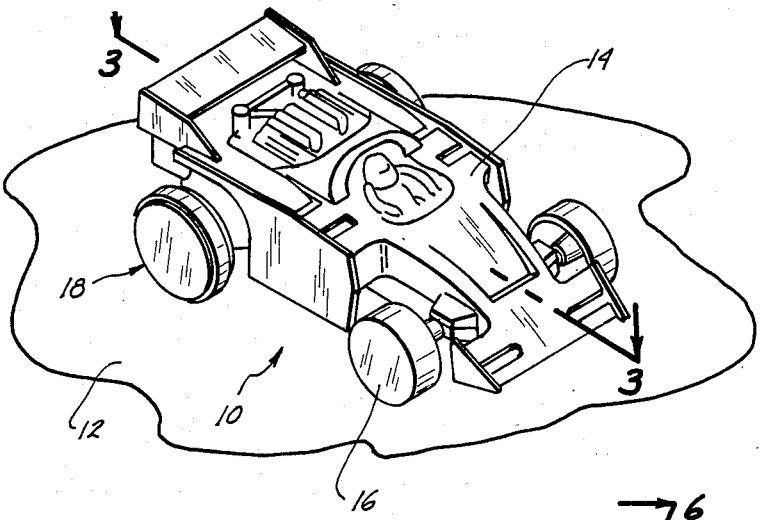
FIG. 1 is a perspective view of the preferred embodiment of the miniature toy car of the present invention.
Figure 2:
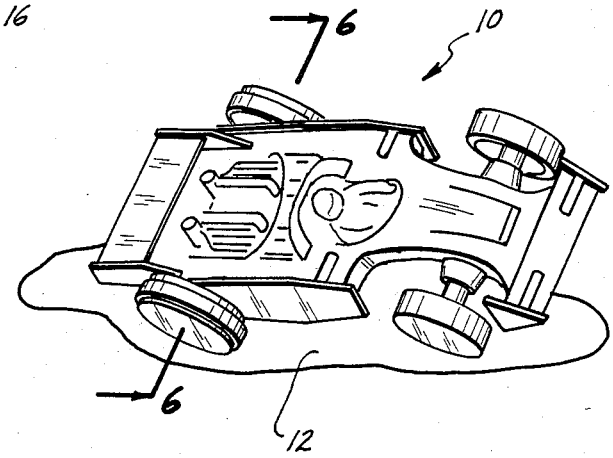
FIG. 2 is a perspective view showing the toy car of FIG. 1 performing a side-wheelie stunt.
Figure 6:
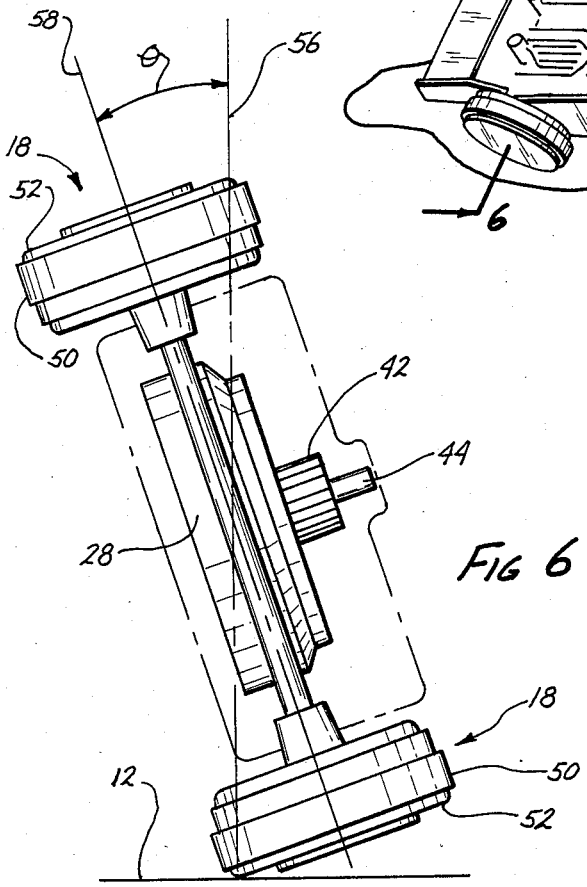
FIG. 6 is a view of the toy car taken along line 6—6 of FIG. 2 showing how the rear wheels of the car contact a supporting surface during a side-wheelie stunt (the body of the car is represented by dashed lines).
Figure 3:
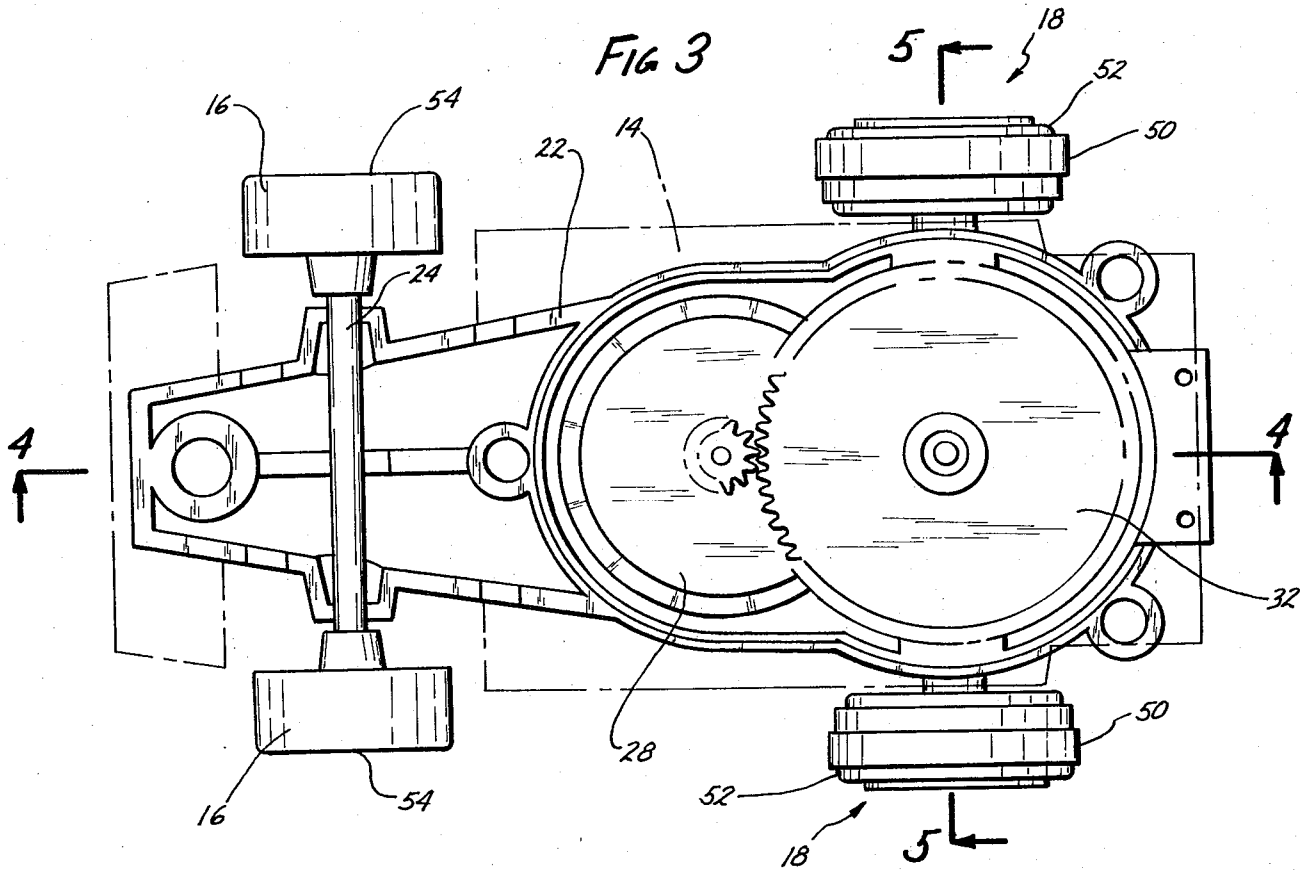
FIG. 3 is a top view taken along line 3—3 of FIG. 1 with the top chassis of the car not shown to reveal an inertial motor used to power the car.
Figure 4:
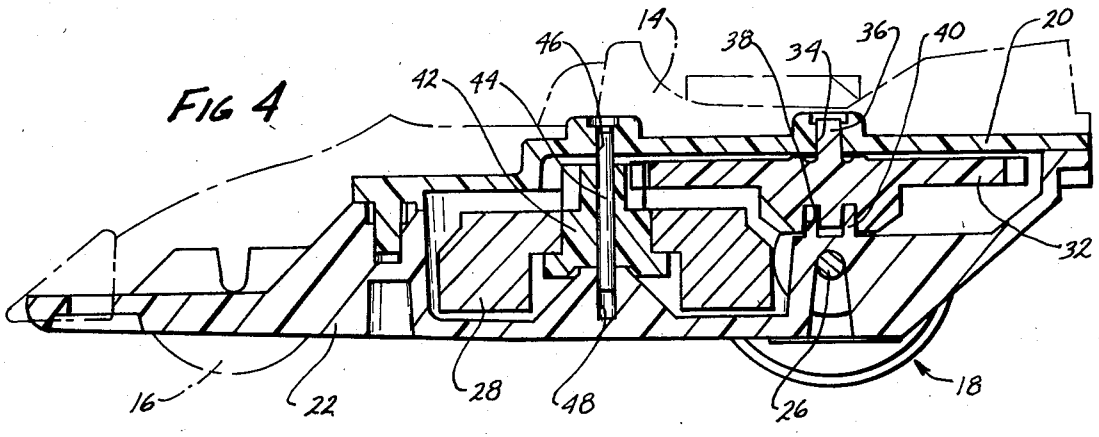
FIG. 4 is a cross-sectional view taken along line 4—4 of FIG. 3.
Figure 5:
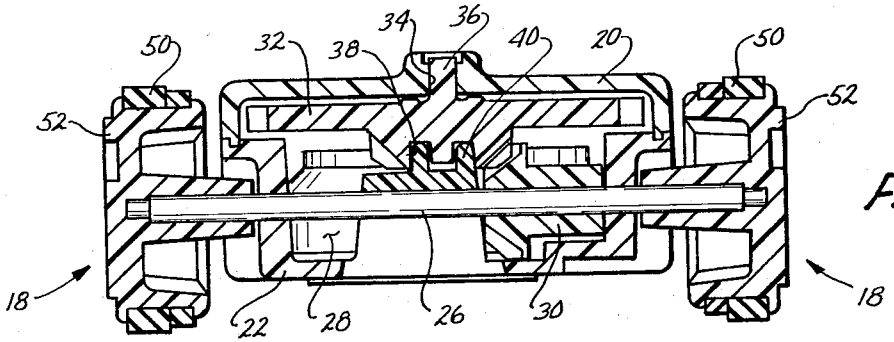
FIG. 5 is a cross-sectional view taken along line 5—5 of FIG. 3.

Referring now to FIG. 1, a preferred embodiment of the toy car 10 of the present invention is shown resting on a supporting surface 12. The toy car 10 has an outer body 14, front wheels 16 and rear wheels 18. As shown in FIGS. 3 through 5, the car 10 has top and bottom chassis 20 and 22, respectively. Front and rear axles 24 and 26, respectively, are rotatably mounted on the bottom chassis 22. Wheels 16 and 18 are attached to axles 24 and 26, respectively, as shown in FIGS. 3, 5 and 6.

The inertia motor of the car 10 utilizes a flywheel 28 for storing kinetic energy. Rotation of the rear wheels 18 causes kinetic energy to be stored in the rotational movement of the flywheel 28. Since axle 26 is attached to the rear wheels 18, rotation of the wheels 18 causes axle 26 and a bevel pinion gear 30 attached to axle 26 to rotate. As the bevel pinion gear 30 rotates with axle 26, it drives a change gear 32 which is rotatably mounted on the bottom chasis 22 causing the gear 32 to rotate inside aperture 34 in the top chasis 20. An extension 36 of change gear 32 rotatably engages aperture 34 as shown in FIGS. 4 and 5. The change gear 32 has an annular groove 38 in its bottom side. An annular extension 40 of the bottom chasis 22 rotatably engages the annular groove 38. The change gear 32 preferably rotates about a vertical axis passing through the longitudinal axis of axle 26.

Referring again to FIG. 4, the change gear 32 drives a pinion gear 42 attached to pin 44 when the rear wheels are rotated. As shown, pin 44 rotatably engages apertures 46 and 48 in the top and bottom chasis 20 and 22, respectively. The pinion gear 42 is attached to the flywheel 28 which rotates with gear 42 about a vertical spin axis when orientated as shown in FIG. 4. It is important to note that the flywheel 28 is positioned toward the bottom of the car 10 as shown in FIGS. 4 and 5 so that its center gravity is substantially in alignment with a horizontal plane passing through longitudinal axis 58 (see FIG. 6) of axle 26. When so aligned, the flywheel 28 helps to balance the car 10 as it performs side-wheelie stunts as explained in the following description.

The rear wheels 18 have high friction material portions 50 attached around the peripheres of the wheels as shown in FIG. 5. Portions 50 facilitate rotation of the wheels 18 as they are rubbed against a surface such as supporting surface 12 for the purpose of causing initial rotation of the wheels 18 and storing kinetic energy in the rotational movement of the flywheel 28. The car 10 is then propelled forward by rotation of the flywheel 28 after it is placed on surface 12. It is important to note that sides 52 of the rear wheels 18 are made out of a low friction material such as plastic in order to allow the car 10 to perform side-wheelie stunts as described below. In addition, sides 54 (see FIG. 3) of the front wheels 16 are also made out of a low friction material to facilitate side-wheelie stunts.

FIG. 6 illustrates how sides 52 of the rear wheels 18 contact supporting surface 12 as the car performs a side-wheelie stunt. Since the center of gravity of the flywheel 28 lies substantially in a horizontal plane passing through longitudinal axis 58 of axle 26, this orientation of the flywheel 28 helps to balance the car 10 when it is in a side-wheelie stunt position as shown in FIG. 6. In other words, the weight of the flywheel 28 helps to balance the remaining weight of the car 10 with repsect to vertical axis 56 during side-wheelie stunts. As such, this orientation of the flywheel 28 allows the car 10 to do side-wheelie stunts with the spin axis of the flywheel approaching a horizontal position and longitudinal axis 58 approaching vertical axis 56 or with angle $\theta$ minimized. When the toy car 10 is in this side-wheelie position, the car 10 operates like a gyro motorcycle having a horizontal spin axis flywheel. In this state, any slight tilting of the toy car 10 generates a torque acting on the longitudinal axis of the car. This torque, with the aid of low friction wheels 16 and 18, causes the car 10 to change its direction of travel. This turning or change of direction of the car 10, in turn, generates a centrifugal force which opposes the initial tilting of the car 10 and restores its balance. This condition exists when the car 10 is resting on its right wheels 16 and 18 and the flywheel 28 is spinning clockwise with the car traveling forward. As previously mentioned, sides 52 and 54 of wheels 18 and 16, respectively, are made out of a low friction material such as plastic which allows the wheels to slide along supporting surface 12 as the car 10 is performing a side-wheelie stunt. As such, the low friction material allows the car 10 to easily slide and make directional changes as the above mentioned restoring torque keeps the car in a balanced position during side-wheelie stunts.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy car for performing side-wheelie stunts comprising:

a bottom chasis having a first aperture and an annular extension;

front and rear axles rotatably engaging said bottom chasis;

a top chasis attached to said bottom chasis having second and third apertures;

front wheels attached to said front axle having sides made out of a low friction material;

rear wheels attached to said rear axle having sides made out of a low friction material and a high friction material surrounding the perephery of each of said rear wheels;

a bevel pinion gear attached to said rear axle;

a change gear having an extension rotatably engaging said second aperture of said top chasis and an annular groove rotatably engaging said annular extension of said bottom chasis, said change gear having a vertical spin axis and engaging said bevel pinion gear;

a pin having one end thereof rotatably engaging said third aperture in said top chasis and the other end thereof rotatably engaging said first aperture in said bottom chasis, said pin having a vertical longitudinal axis;

a pinion gear attached to said pin, said pinion gear rotating about said vertical longitudinal axis of said pin and engaging said change gear; and a flywheel attached to said pinion gear, said flywheel having a vertical spin axis and a center of gravity substantially located in a horizontal plane passing through the longitudinal axis of said rear axle so that said toy car is capable of balancing on said sides of said front and rear wheels when said toy car is performing side-wheelie stunts on a supporting surface and said longitudinal axis of said rear axle substantially approaches a vertical position when said toy car is performing said side-wheelie stunts.

2. A toy car comprising:

a bottom chasis;

front and rear axles rotatably engaging said bottom chasis;

a top chasis attached to said bottom chasis;

front wheels attached to said front axle having sides made out of a low friction material;

rear wheels attached to said rear axle having sides made out of a low friction material, each of said rear wheels having a high friction material surrounding the perephery thereof;

gear means mounted inside said top and bottom chasis for engaging said rear axle including a bevel pinion gear attached to said rear axle, a change gear engaging said bevel gear and a pinion gear engaging said change gear, said change gear having an extension rotatably engaging a first aperture in said top chasis and an annular groove rotatably engaging an annular extension in said bottom chasis; and horizontally mounted flywheel means engaging said pinion gear for storing kinetic energy and generating a restoring torque for balancing said toy car on said sides of said front and rear wheels so that the longitudinal axis of said rear axle substantially approaches a vertical position during side-wheelie stunts, said flywheel means having a vertical spin axis and a center of gravity substantially located in a horizontal plane passing through the longitudinal axis of said rear axle.

3. The toy car of claim 2 further comprising a pin attached to said pinion gear having a common spin axis with said pinion gear, one end of said pin rotatably engaging a second aperture in said top chasis and the other end of said pin rotatably engaging an aperture in said bottom chasis.

* * * * *